US007832209B2

(12) United States Patent
Formosa

(10) Patent No.: US 7,832,209 B2
(45) Date of Patent: Nov. 16, 2010

(54) MINIATURISED DEVICE THAT CAN OPERATE AS AN ENGINE OR A COOLER ACCORDING TO A STIRLING THERMODYNAMIC CYCLE

(75) Inventor: Fabien Formosa, Chavanod (FR)

(73) Assignee: Commissariat a l'Energie Atomique, Paris (FR)

( * ) Notice: Subject to any disclaimer, the term of this patent is extended or adjusted under 35 U.S.C. 154(b) by 201 days.

(21) Appl. No.: 12/267,686

(22) Filed: Nov. 10, 2008

(65) Prior Publication Data

US 2009/0056330 A1 Mar. 5, 2009

Related U.S. Application Data

(63) Continuation of application No. PCT/FR2007/051282, filed on May 16, 2007.

(30) Foreign Application Priority Data

May 17, 2006 (FR) ..... 06 51785

(51) Int. Cl.
*F01B 29/10* (2006.01)
*F02G 1/04* (2006.01)
*F25B 9/00* (2006.01)

(52) U.S. Cl. ..... 60/517; 60/525; 62/6

(58) Field of Classification Search ..... 60/516–526; 62/6

See application file for complete search history.

(56) References Cited

U.S. PATENT DOCUMENTS

| | | | |
|---|---|---|---|
| 5,457,956 | A | 10/1995 | Bowman et al. |
| 5,749,226 | A | 5/1998 | Bowman et al. |
| 5,941,079 | A | 8/1999 | Bowman et al. |
| 6,385,973 | B1 | 5/2002 | Moran |

FOREIGN PATENT DOCUMENTS

| | | | |
|---|---|---|---|
| JP | 62-248857 | A1 | 10/1987 |
| WO | 97/13956 | A1 | 4/1997 |

*Primary Examiner*—Thomas E Denion
*Assistant Examiner*—Christopher Jetton
(74) *Attorney, Agent, or Firm*—Burr & Brown

(57) ABSTRACT

Miniaturised device, which can operate as an engine or a cooler according to a Stirling thermodynamic cycle, comprising an expansion chamber and a compression chamber, which are interconnected by means of a regenerator enabling the working fluid to flow through from the expansion chamber to the compression chamber, and vice versa, under the effect of the movement of a displacing mechanism, a fraction of the compression chamber being mobile and operating as a piston in order to modify the volume of the said compression chamber, characterized in that it also comprises a complementary chamber which is connected to the compression chamber by means of a complementary connection channel, the said complementary chamber being at an intermediate temperature between the temperature of the compression chamber and the temperature of the expansion chamber, the complementary chamber being separated from the expansion chamber by means of the displacing mechanism.

10 Claims, 3 Drawing Sheets

MINIATURISED DEVICE THAT CAN OPERATE AS AN ENGINE OR A COOLER ACCORDING TO A STIRLING THERMODYNAMIC CYCLE

TECHNICAL FIELD

The invention relates to the field of microelectromechanical systems, also called MEMS. It relates more particularly to microsystems or miniaturised devices for converting mechanical energy into heat and vice versa. It relates more specifically to the miniaturised devices operating according to a Stirling thermodynamic cycle, and in particular according to the configurations called $\alpha$ and $\beta$ of this type of heat engine.

PRIOR ART

In general, a heat engine operating according to a Stirling thermodynamic cycle comprises an expansion chamber and a compression chamber which are connected by means of a regenerator, enabling a working fluid, which is generally a gas, to flow from the expansion chamber to the compressor chamber and vice versa, under the effect of the movement of a piston commonly called "displacer". A "drive" piston allowing the transfer of energy in the form of mechanical work is mobile in a fraction of the compression chamber, in order to modify its volume. The movements of the displacing piston and of the drive piston are synchronised and their phase difference is maintained by a synchronising device, to ensure optimal operation according to a Stirling cycle.

In fact, an ideal Stirling thermodynamic cycle for operation in engine mode, combines four phases during which the working fluid undergoes the following transformations: that is, heating at constant volume, isothermal expansion, followed by cooling at constant volume, followed by isothermal compression. In the context of operation in engine mode, the compression chamber is thermally connected to a heat source, so that the working fluid in the compression chamber is at a lower temperature than in the expansion chamber.

Engines called "Stirling" engines have already been developed for locomotion functions and as subsystems for electric power generation. The reversibility of a Stirling engine is also exploited to produce industrial refrigeration. Developments have also been achieved to miniaturise this type of engine, and in particular to produce it by techniques used in the field of microelectronics. Such devices thus belong to the general category of microelectromechanical systems or MEMS.

Thus, documents U.S. Pat. No. 5,457,956, U.S. Pat. No. 5,749,226 and U.S. Pat. No. 6,385,973 describe MEMS devices operating according to Stirling cycles. Such mechanisms therefore group together, in a very small confined space, all the elements for the operation of the Stirling engine or cooler. Another example of a Stirling engine produced with a MEMS structure as described in document WO 97/13956. In certain configurations considered in this document, the compression chamber may integrate a fraction of a heat exchanger for exchanging heat with the lateral region of the device. The presence of this heat exchanger fraction divides the compression chamber into two parts which are nevertheless at the same temperature, because of the high thermal conductivity of the heat exchanger fraction, which is necessary for a good heat transfer coefficient.

A problem arises with this type of device, insofar as their miniaturisation inevitably causes a reduction in their performance. More precisely, the ideal thermodynamic efficiency of a Stirling engine is equal to $1-T_D/T_C$, where $T_D$ and $T_C$ are the temperatures prevailing in the expansion and compression chambers respectively.

It can therefore be clearly understood that the efficiency is commensurately higher as the temperature difference between the expansion chamber and the compression chamber is greater. In fact, the more a device is miniaturised, the closer the expansion chamber is to the compression chamber, so that the thermal insulation between the two chambers cannot be effectively maintained.

In other words, the heat dissipated in the expansion chamber causes a temperature increase in the compression chamber by thermal conduction across the elements of the systems, and hence a reduction of the temperature difference, which is synonymous with a drop in efficiency.

Thus, with the materials commonly used in the MEMS industry, the thermal insulation between the two chambers, when they are separated by a few microns, is unsatisfactory.

A problem that the invention therefore proposes to solve is to preserve the satisfactory performance in terms of thermodynamic efficiency, and to do so while allowing for a particularly compact configuration.

Document U.S. Pat. No. 5,941,079 describes several combinations of elementary structures of Stirling devices. Such architectures impose particular arrangements in order to be controlled. In fact, in steady state conditions, the adjustment of the phase difference between the movement of the displacing piston connected to the expansion chamber, and the drive piston connected to the compression chamber, is obtained by an appropriate design of the dynamic characteristics of the displacing piston and the drive piston associated with viscous dissipation mechanisms in the regenerator. In the case of operation in engine mode, the starting and synchronisation of the movements of the displacing piston and of the drive piston can only be obtained by control through the use of an actuation device thereof. The converter used may accordingly be of the electromechanical, piezoelectric, electrostatic or electrostrictive type.

A further object of the invention is to propose a structure of a Stirling engine or cooler that does not require the simultaneous control of the displacing mechanism and of the drive piston to obtain the desired operation.

SUMMARY OF THE INVENTION

The invention therefore relates to a miniaturised device, which can operate as an engine or a cooler according to a Stirling thermodynamic cycle. Conventionally, such a device comprises an expansion chamber and a compression chamber, which are interconnected by means of a regenerator enabling the working fluid to flow through from the expansion chamber to the compression chamber, and vice versa, under the effect of the movement of a displacing mechanism, also simply called displacer.

Conventionally, a fraction of the compression chamber is mobile and operates as a piston in order to modify its volume.

According to the invention, this device is characterized in that it also comprises a complementary chamber which is connected to the compression chamber by means of a complementary connection channel. This complementary chamber is separated from the expansion chamber by the displacing mechanism. This complementary chamber is at an intermediate temperature between the temperature of the compression chamber and the temperature of the expansion chamber.

In other words, compared to conventional configurations, the device according to the invention comprises an additional chamber, which serves to transfer the pressure effect existing in the compression chamber to the side of the displacer opposite the expansion chamber. The complementary connection channel and the arrangements and materials selected serve to maintain a substantial temperature difference between the compression chamber and the complementary chamber.

In other words, contrary to conventional systems in which the two sides of the displacer are in contact with the expansion and compression chambers respectively, the device according to the invention is characterized in that the displacer is in indirect contact with the compression chamber via the characteristic complementary chamber.

In this way, the complementary chamber may be at an intermediate temperature between that of the expansion chamber and that of the compression chamber. Thus, the temperature difference between the two sides of the displacer is lower than in conventional systems, at a constant temperature difference between the expansion chamber and the compression chamber.

It is therefore possible to produce miniaturised devices, having a satisfactory efficiency, despite a very small thickness of the displacing device, which can therefore be made by conventional means for obtaining micron-scale membranes.

Advantageously in practice, the connection channel connecting the complementary chamber to the compression chamber may include a specific thermal arrangement, in order to maintain a temperature difference between the compression chamber and the complementary chamber, and thereby promote a significant temperature difference between the compression chamber and the expansion chamber.

In practice, this temperature difference can be maintained by various devices. Thus, an active device may be provided for regulating the temperature of the gas flowing in the connection channel. This device may comprise heat transfer elements which heat or cool this gas, as required. Advantageously, the regulation device may be formed by a complementary regenerator.

According to another feature of the invention, the displacer has two contact surfaces, respectively with the expansion chamber and the complementary chamber, which have different areas. In other words, the contact surface between the displacer and the expansion chamber is typically greater than the contact surface between the complementary chamber and the said displacer. This asymmetry has advantages with regard to the design of the mechanism which ensures the self-starting and maintenance of an optimal phase difference between the movement of the displacer and that of the piston associated with the compression chamber. In fact, in an operation in engine mode, the starting can be obtained by the appropriate choice of the dynamic characteristics of the displacer and of the element acting as the drive piston. The dynamic system formed by the displacing mechanism and the element acting as a piston, which is stable up to the temperature differential between the expansion chamber and the compression chamber, becomes dynamically unstable beyond this temperature difference thanks to the pressure feedback on the surface of the displacer in contact with the fluid contained in the complementary chamber. This instability provokes the movement of the displacer and of the element acting as a piston upon the least disturbance. The amplitude of the displacements increases so that non-linear dissipation mechanisms modify the dynamic range of the system to reach a stable operating point. The synchronisation of the movements of the displacer and of the element acting as a piston is then dependent on the dynamic characteristics of the displacing mechanism and of the piston, and also on the viscous dissipation mechanisms in the regenerator and the complementary channel. Moreover, a mechanical limitation of the amplitude of movement of the element acting as a drive piston may also be implemented in order to obtain the desired thermodynamic characteristics.

In practice, the regenerator, and also optionally the connection channel, may be arranged in various ways, according to the properties of the working fluid, the desired thermal performance, and the technologies available. Thus, more precisely, the flow of the working fluid in the regenerator and the connection channel or channels may take place in a direction parallel to the direction defined between the expansion chamber and the compression chamber. In this case, the regenerator and the connection channel may be composed of a plurality of tubular channels excavated in the thickness of the material of the component.

In another alternative, this regenerator may allow the flow of the working fluid in a plane perpendicular to the said direction defined between the expansion and compression chambers. In this case, the surface area of the regenerator may be higher. Depending on the type of regenerator design, it is thereby possible to adjust the pressure drops generated at the crossing of the regenerator or regenerators, and also the temperature difference between the two ends of the regenerator.

According to another feature of the invention, it is possible for the expansion chamber and the compression chamber to be arranged in two distinct components, and to be connected by lines appropriately providing the connection between the various chambers. In this way, the distance between the compression chamber and the expansion chamber is further increased, in order to increase the temperature difference between these two chambers, and therefore the efficiency of the device.

In practice, the device according to the invention may comprise a synchronisation mechanism between the movement of the displacer and the element acting as a piston. In a manner that is not necessarily mandatory, this synchronisation mechanism comprises a pressurised chamber arranged so that the surface of the element acting as a piston, opposite the compression chamber, is subject to this pressure. The frequency associated with the element acting as a drive piston can then be modified by adjusting this pressure by an appropriate device. In a manner that is not necessarily mandatory, this synchronisation mechanism may comprise stops which limit the amplitude of movement of the element acting as a piston to a value ensuring the optimal operation of the device used in engine mode. A device for controlling the element acting as a drive piston may also be added. It accordingly comprises an electromechanical converter associated with a control circuit for controlling the amplitude and/or frequency and/or damping associated with the element acting as a piston.

The design of the device according to the invention makes it usable as an engine, in order to convert thermal energy into mechanical energy, or as a cooler, that is in order to convert mechanical energy into heat energy.

Many configurations may be considered for the thermal connection between the expansion and compression chambers and the heat sources. It is thereby possible to provide for particular arrangements such as fins, in order to increase the heat exchange area with the heat sources.

For operation in engine mode, the mechanical energy produced at the element acting as a piston can be used and converted in various ways, for example into electrical energy, by the use of converters of various types such as electrostatic, electromagnetic or piezoelectric for example. It may be observed that in this case, the converter used may form part of the engine control device.

Conversely, in the case of operation in cooler mode, the piston acting on the compression chamber may be associated with a member capable of initiating the displacement by the use of converters of various types such as electrostatic, electromagnetic or piezoelectric for example.

BRIEF DESCRIPTION OF THE FIGURES

The manner of implementing the invention and the advantages thereof will appear clearly from the description of the embodiment that follows, in conjunction with the appended figures in which.

MANNER OF IMPLEMENTING THE INVENTION

Figure 1:
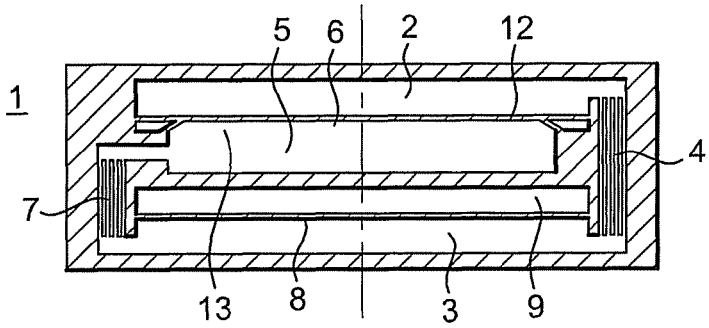
FIG. 1 shows a schematic section of the main part of the device according to the invention, shown exclusively with regard to the essential elements in relation to the invention.

As already stated, the invention relates to a miniaturised device, of the MEMS type, operating according to a Stirling thermodynamic cycle. FIG. 1 shows such a device (1), in which only the essential elements for the understanding of the invention are shown, and in which the entire environment of the invention is not shown, which may be necessary for the operation of the invention.

Thus, the device (1) shown in FIG. 1, comprises an expansion chamber (2), a compression chamber (3), which are interconnected by a regenerator (4). According to the invention, the device (1) also comprises a complementary chamber (5) which is separated from the expansion chamber (2) by a displacing mechanism (6).

This complementary chamber (5) is connected to the compression chamber (3) by means of a connection channel (7), or in general by a specific connection. The compression chamber (3) has one of its walls (8) which is mobile, in order to vary its volume. This wall, acting as a piston (8) moves within a volume (9) provided for the purpose. According to the configuration of this volume (9), to the pressure prevailing therein, and to the type of gas that it contains, the thermal insulation between the compression and expansion chambers may be favoured.

Thus, the displacer (6) has its upper face (12) which is in contact with the expansion chamber (2), whereas the lower face (13) of the said displacer (6) is in contact with the complementary chamber (5), connected to the compression chamber (3). The specific connection (7) ensures the maintenance of a temperature difference between the intermediate chamber (5) and the compression chamber (3), so that the temperature gradient in the displacer (6) is lower than in conventional systems, assuming identical theoretical efficiency.

As shown in FIG. 1, the lower face (13) of the displacer (6) has an area smaller than the area of the upper face (12) of the said regenerator, which is in contact with the expansion chamber (2). This asymmetry between the two faces of the displacer is advantageous with regard to the starting and maintenance of the optimal phase difference between the movement of the displacer and that of the piston associated with the compression chamber.

This asymmetry may be generated by different geometries of the two faces (12) and (13) of the displacer (6), or by the presence of specific stiffeners present on one of its two faces. The production of the displacer (6) may integrate the consideration of the stiffness parameters to be imparted to the displacer.

In the case in which the device (1) operates as an engine, the expansion chamber (2) is thermally connected to the heat source (not shown), which may be of various types. Thus, it may involve contact with a combustion chamber, or a heat sensor, capable of receiving energy by conduction, convection or radiation.

Similarly, the piston (8), which is mobile during the operation of the device, may be associated with various electrical converters for converting the movement of the piston (8) into an electrical energy acting by various principles, according to the applications. Thus, the conversion may occur by a piezoelectric, electrostatic or electromagnetic effect for example.

Figure 2:
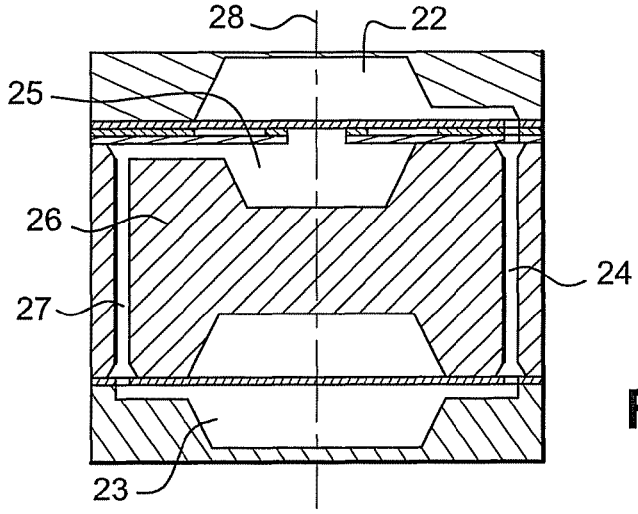
FIGS. 2 and 3 show sections of alternative solutions concerning the positioning and orientation of the regenerator and the production of the displacer.
Figure 3:
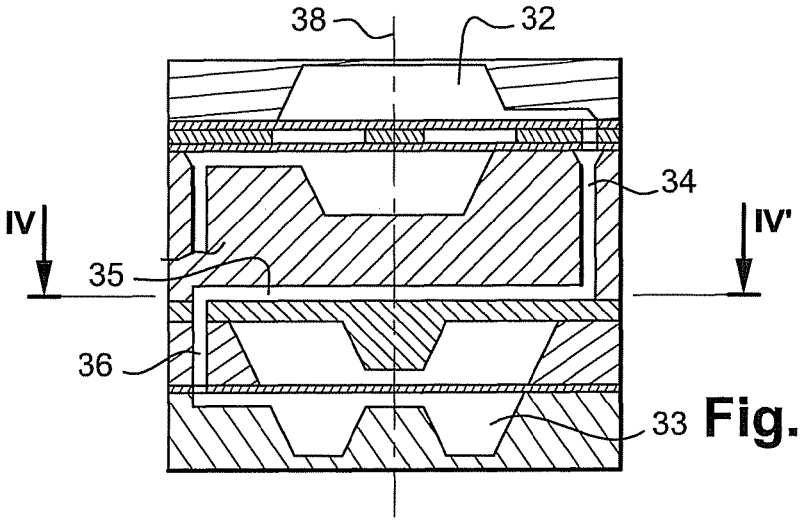

In practice, the device according to the invention may be produced within one and the same component, as shown in FIGS. 2 and 3. Thus, as shown in FIG. 2, the expansion chamber (22) is connected to the compression chamber (23) by means of the regenerator (24). The complementary chamber (25) is itself connected to the compression chamber (23) by means of the connection channel (27).

In this configuration, the regenerator and the connection channel (24, 27) have a multitube configuration, parallel to the direction (28) connecting the compression chamber (23) to the expansion chamber (22). In other words, these regenerators consist of lines excavated in the thickness of the material (26) separating the complementary chamber (25) from the compression chamber (23).

In an alternative configuration, shown in FIG. 3, the expansion chamber (32) is connected to the compression chamber (33) by means of the regenerator composed of a first tubular portion (34), parallel to the direction (38) connecting the compression (33) and expansion (32) chambers. This first portion (34) is extended by a planar portion (35) extending in a plane perpendicular to the direction (38) connecting the compression and expansion chambers. A third portion (36) parallel to the direction (38) connects the planar portion (35) of the regenerator to the compression chamber.

Figure 4:
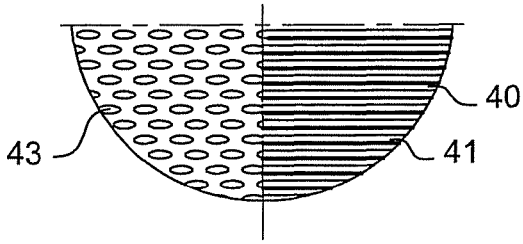
FIG. 4 shows a cross section along IV-IV' in FIG. 3, showing specific arrangements of the regenerator and of the connection channel.

FIG. 4 shows the geometry that the various elements constituting the active part of the regenerator may adopt. Thus, a first fraction of this active part of the regenerator is shown with channels (40) separated by virtually straight portions (41). These channels (40) serve to define a relatively high contact surface, and to limit the pressure drops generated by the passage of the working fluid in the active part of the regenerator.

In the left hand fraction of the regenerator shown in FIG. 4, the elements serving to provide the heat buffer effect are in the form of studs (43) arranged in staggered rows, assuming a desire to create turbulences in order to improve the heat exchange between the working fluid and the active elements of the regenerator.

In general, the device according to the invention may be produced by conventional techniques in the field of MEMS. According to the scale of the devices, it is also possible to employ other techniques, for producing membranes. Thus, these membranes may be produced from films which are drawn in order to generate a uniform tension in the thickness thereof. The drawn films thus prestreched are assembled on the device in order to obtain the displacer on the one hand and the piston on the other. Advantageously, this tension is such that the dynamic behaviour of the device according to the invention depending on the resonance frequencies of the membranes acting as piston and displacer is adapted to the operating conditions.

Figure 5:
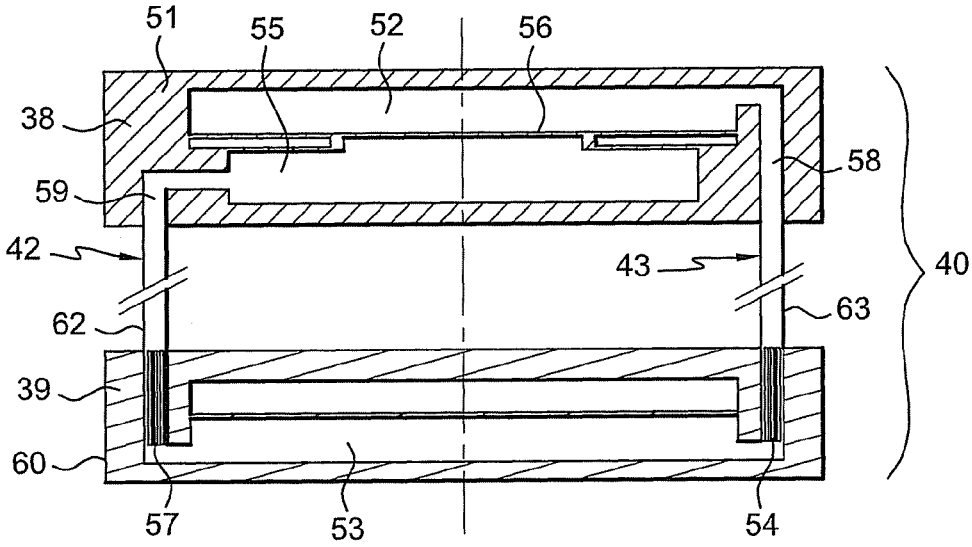
FIGS. 5 and 6 show schematic sections of two alternative embodiments showing the device produced in the form of two interconnected components.
Figure 6:
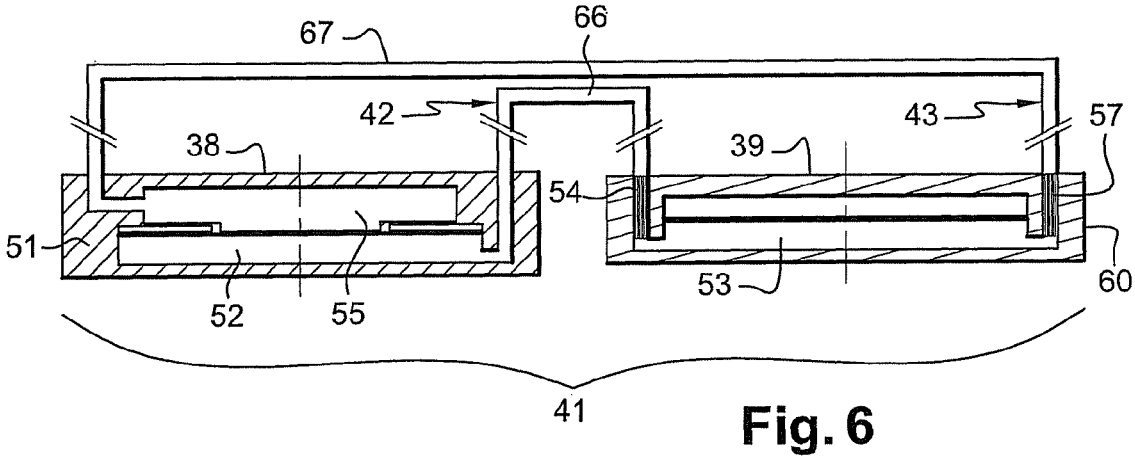

The configuration shown in FIGS. 5 and 6 has an advantage in terms of thermal insulation between the expansion chamber and the compression chamber. More precisely, the expansion chamber (52) shown in FIG. 5 is separated from the complementary chamber (55) by means of the displacer (56), which has an asymmetrical configuration. The expansion (52) and complementary (55) chambers are produced inside a first component (51), which comprises various lines (58), (59) for connection with the second component (60) which contains the compression chamber (53), the regenerator (54) and the specific connection (57). The lines (62, 63) which connect the two components (51, 60) have the desired geometry and in particular the desired length, according to the distance of the two components (51, 60).

In the configuration shown in FIG. 6, the two components (51, 60) are shown side by side, and may in particular be produced at the level of one and the same substrate. In this case, the lines (66) connecting the expansion chamber (52) and the regenerator (54), and the line (67) connecting the complementary chamber (55) and the connection channel (57) are produced in an appropriate way, either outside the two components (51, 60), or may be formed in the actual thickness of the material for making the two components and in accordance with the geometric layout limitations.

Figure 7:
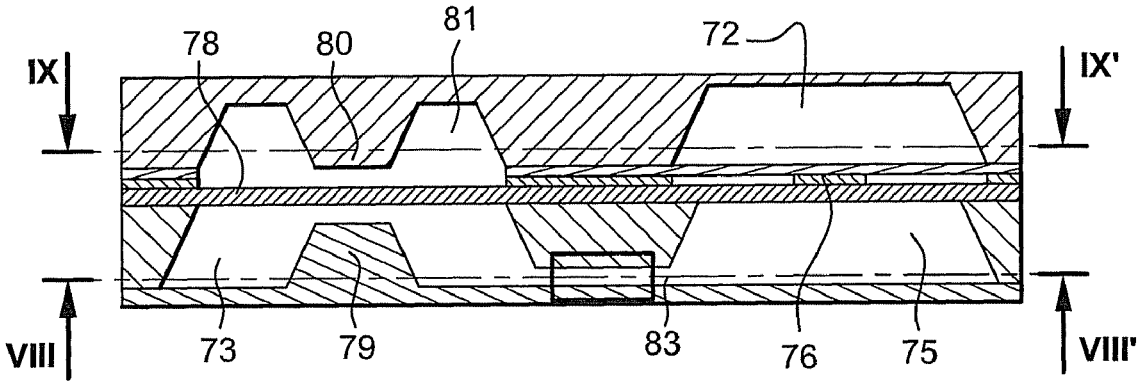
FIG. 7 shows a section of an alternative embodiment concerning the positioning of the various characteristic chambers of the invention.

Such a configuration is described in particular in FIG. 7 in which the expansion chamber (72) is produced above the complementary chamber (75) from which it is separated by the displacer (76). The compression chamber (73) is produced in an offset portion of the overall component, and has a piston (78) which defines the upper part. This piston (78) can travel between stops (79, 80) formed respectively in the compression chamber (73) and the volume (81) located on the other side of the piston (78).

Figure 8:
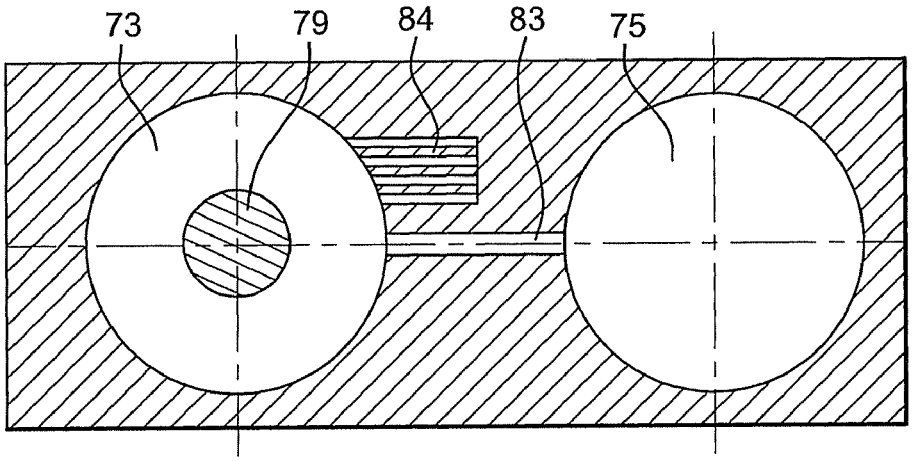
FIGS. 8 and 9 show sections of FIG. 7 along VIII-VIII' and IX-IX' respectively.
Figure 9:
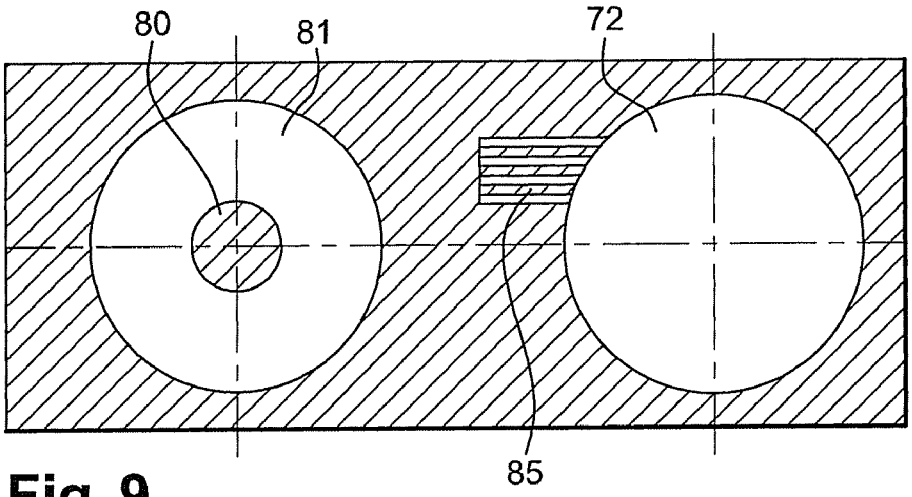

As shown in FIG. 1, the compression chamber is connected to the complementary chamber by a line (83), which may include a heat transfer device (not shown). Similarly, the compression chamber (73) is connected to the expansion chamber (72) by means of the regenerator, of which part (84) is shown in FIG. 8, and which is prolonged by an additional fraction (85) shown in FIG. 9. The two portions (84, 85) of the main regenerator are connected by a portion passing through the thickness between the two cross sectional planes VIII-VIII', IX-IX'.

Obviously, many other geometries may be adopted to improve various factors, associated either with the performance of the device, or with the technological limitations of fabrication or integration. In the embodiment shown in FIGS. 7 to 9, the compression and expansion chambers have a circular geometry, which enhances their mechanical robustness.

It appears from the above that the device according to the invention has the major advantage of allowing a miniaturisation of Stirling machines, while preserving a satisfactory efficiency, through the maintenance of a high temperature difference between the expansion chamber and the compression chamber. Moreover, the absence of complex kinematics and linkages helps to overcome the problems of mechanical wear of parts in relative movement and the appearance of play which generates impact and vibrations. The low inertias in movement also limit the vibrations transmitted by the device to its environment, thereby limiting the noise generated.

INDUSTRIAL APPLICATIONS

The device according to the invention can find many applications, among which mention can be made of microelectric power generation, heat energy recovery and utilisation, and the cooling of electronic systems in particular.

In the case of power generation, from a chemical energy source, the heat energy required is generated by catalytic combustion and the device according to the invention allows the effective conversion of the heat energy into mechanical energy, which is finally converted into electrical energy usable by a converter built into the device. Electric power generation can also be considered by using the device according to the invention in series and arranged in such a way that the heat energy of the environment (solar radiation, heat energy dissipated by a process) is efficiently converted into electrical energy.

The device according to the invention used in cooler mode may be applied to cooling IT electronic components which require temperature control. The range of temperature differences accessible by the use of the device operating in a Stirling cycle allows the consideration of its use in low temperature cooling applications for the infrared sensors of a thermal camera for example.

The invention claimed is:

1. A miniaturised device, which can operate as an engine or a cooler according to a Stirling thermodynamic cycle, comprising an expansion chamber and a compression chamber, which are interconnected by means of a regenerator enabling the working fluid to flow through from the expansion chamber to the compression chamber and vice versa, under the effect of the movement of a displacing mechanism, a fraction of the compression chamber being mobile and operating as a piston in order to modify the volume of said compression chamber, wherein it also comprises a complementary chamber which is connected to the compression chamber by means of a complementary connection channel, the said complementary chamber being at an intermediate temperature between the temperature of the compression chamber and the temperature of the expansion chamber, the complementary chamber being separated from the expansion chamber by means of the displacing mechanism.

2. The device according to claim 1, wherein the connection channel includes a complementary regenerator.

3. The device according to claim 1, wherein the displacing mechanism has two contact surfaces, with the expansion chamber and the complementary chamber respectively, which have different areas.

4. The device according to claim 1, wherein the main regenerator and/or the complementary connection channel enable the working fluid to flow in a direction parallel to the direction defined between the expansion chamber and the compression chamber.

5. The device according to claim 1, wherein the main regenerator and/or the complementary connection channel enable the working fluid to flow in a plane perpendicular to the direction defined between the expansion chamber and the compression chamber.

6. The device according to claim 1, wherein the expansion chamber and the compression chamber are arranged in two distinct components, and are connected by lines.

7. The device according to claim 1, wherein it comprises a synchronisation mechanism between the movement of the displacer and the movement of the element operating as a piston.

8. The device according to claim 1, wherein the expansion chamber is thermally connected to a heat source and optionally comprises arrangements for increasing the heat exchange area with the heat source.

9. The device according to claim 1, wherein the element operating as a piston or the element operating as a displacer is associated with a member suitable for initiating its displacement.

10. The device according to claim 1, wherein the element operating as a piston is associated with a member suitable for converting its mechanical energy into electrical energy.

* * * * *